US005280461A

United States Patent [19]

Belik

[11] Patent Number: 5,280,461

[45] Date of Patent: Jan. 18, 1994

[54] SINGLE HAND TIMEPIECE WITH SINUSOIDAL DISPLAY

[76] Inventor: Jaroslav Belik, 1610 Mulcahy, Rosenberg, Tex. 77471

[21] Appl. No.: 975,857

[22] Filed: Nov. 13, 1992

[51] Int. Cl.[5] ..... G04B 19/04

[52] U.S. Cl. ..... 368/228; 368/238; 368/223

[58] Field of Search ..... 368/223-239; 76-8

[56] References Cited

U.S. PATENT DOCUMENTS

| | | | |
|---|---|---|---|
| 4,991,154 | 2/1991 | Perucchi . | |
| 5,103,434 | 4/1992 | Sullivan . | |
| 5,111,439 | 5/1992 | Erard | 368/19 |
| 5,134,596 | 7/1992 | Harris . | |
| 5,172,350 | 12/1992 | Walen et al. | 368/238 |
| 5,208,790 | 5/1993 | Sato | 368/15 |

*Primary Examiner*—Bernard Roskoski
*Attorney, Agent, or Firm*—Harrison & Egbert

[57] ABSTRACT

A timepiece is provided in the form of a body having a face which displays a sinusoidal path of multiples of twelve wavelengths within a circular periphery, and concentric rings on the face which intersect the path. An arm rotates about the center of the face a rate of one revolution per every twelve hours. A time-indicating pointer, mounted for guided longitudinal movement with respect to the arm, reciprocates with respect to the arm at one cycle per hour. The combined rotation of the arm and reciprocation of the pointer cause the pointer to follow the sinusoidal path, such that the pointer indicates hours by its circumferential position relative to the crests of the wavelengths and indicates minutes by its radial position relative to the concentric rings.

6 Claims, 4 Drawing Sheets

SINGLE HAND TIMEPIECE WITH SINUSOIDAL DISPLAY

BACKGROUND OF THE INVENTION

The present invention relates to improvements in timepieces of the "analog" type wherein one or more hands rotate about the center of the face of the timepiece to point to markings or indicia spaced circumferentially about the face to represent time.

In the typical two-hand configuration, the longer hand rotates at a speed of one revolution per hour and indicates minutes of the hour. The shorter hand rotates at one revolution per every twelve hours and indicates hours of the day. The two hands are therefore driven at different rotational rates.

The typical single-hand timepiece merely omits the faster-rotating hand used to indicate minutes. Both minutes and hours are then measured by the relative position of the single hand to and between the hour markings or indicia on the face of the timepiece. Accurate time measurement is necessarily compromised at the expense of aesthetic value in this device because, in the case of a twelve hour timepiece for example, the minutes of the hour must be distinguished within a 30 degree arc as opposed to a 360 degree arc on the standard two-hand timepiece.

In another single-hand timepiece, as shown in U.S. Pat. No. 4,991,154, the hand indicates minutes of the hour only. Hours are indicated by a digital counter wheel, whose rotation is indirectly provided by the hand's clocking mechanism. Indicia on the counter is displayed through the face of the timepiece. This design maintains the precision, as to time indication, of the standard two-hand timepiece, but the invention's potential for confusion limits its own design. Specifically, the timepiece is dependent upon the use of indicia of its face indicative of minutes. Otherwise, the digital indication displayed through the face lacks clarity as to the unit of time it represents.

U.S. Pat. No. 5,103,434 discloses the use of a single hand which rotates at one revolution per every twelve hours about a periphery point, and a face which rotates at one revolution per hour about its center. Time is indicated by the relative direction of the hand with respect to a first reference point and simultaneously, the relative position of the periphery point about the center point with respect to a second reference point, all of which renders it complicated and confusing to read.

U.S. Pat. No. 5,134,596 discloses a single-hand timepiece with a rotation rate of one revolution per every twelve hours. The face of the timepiece displays an inner ring which is numbered to indicate hours, and an outer ring provided with indicia to indicate minutes on the hour as the hand rotates about the face. While allowing for accurate determination of time, this invention requires excessive use of indicia on its face denying it a sophisticated appearance.

The prior art therefore lacks a single-handed timepiece which embodies the simplicity and fidelity of the typical two-hand configuration in an artistically pleasing manner. It is therefore an object of the present invention to provide a timepiece that functions in a manner which is easy to read, capable of accurate time indication, and aesthetically pleasing to the user.

SUMMARY OF THE INVENTION

The present invention comprises a timepiece in the form of a case or body having a face which displays a sinusoidal path of multiples of twelve wavelengths within a circular periphery, and concentric rings on the face which intersect the path. The timepiece's clocking mechanism which is mounted on the body includes an output shaft arranged centrally with respect to the sinusoidal path on the face. An arm is mounted for rotation about the output shaft and extends radially from the shaft, and means are provided for connecting the output shaft to the arm for inducing stepped-down rotation of the arm about the output shaft so that 13/12 revolutions of the output shaft define one hour while one revolution of the arm defines multiples of twelve hours.

A time-indicating pointer is mounted for guided longitudinal movement with respect to the arm, and means are provided for connecting the output shaft to the pointer for inducing reciprocating motion of the pointer with respect to the arm which causes the pointer to track the sinusoidal path upon rotation of the output shaft. Thus, the pointer indicates hours by its circumferential position relative to the crests of the wavelengths and indicates minutes by its radial position relative to the concentric rings.

In a preferred embodiment, the means connecting the output shaft to the arm comprise a sun gear mounted on the output shaft and rotating with it, a ring gear mounted on the face of the body centrally with respect to the output shaft, and a planetary gear carried by the arm radially outward from the output shaft with its teeth engaging those of the sun gear and the ring gear. On the other hand, the means connecting the output shaft to the pointer in this preferred embodiment comprise a crank arm connected to the output shaft for rotating with it, and a connecting rod pivotally connecting the crank arm to the pointer. Thus, there is provided a simple and compact arrangement for accomplishing these two functions.

BRIEF DESCRIPTION OF THE DRAWINGS

In the drawings, wherein like reference characters are used throughout to describe like parts.

DETAILED DESCRIPTION OF THE PREFERRED EMBODIMENT

Figure 2:
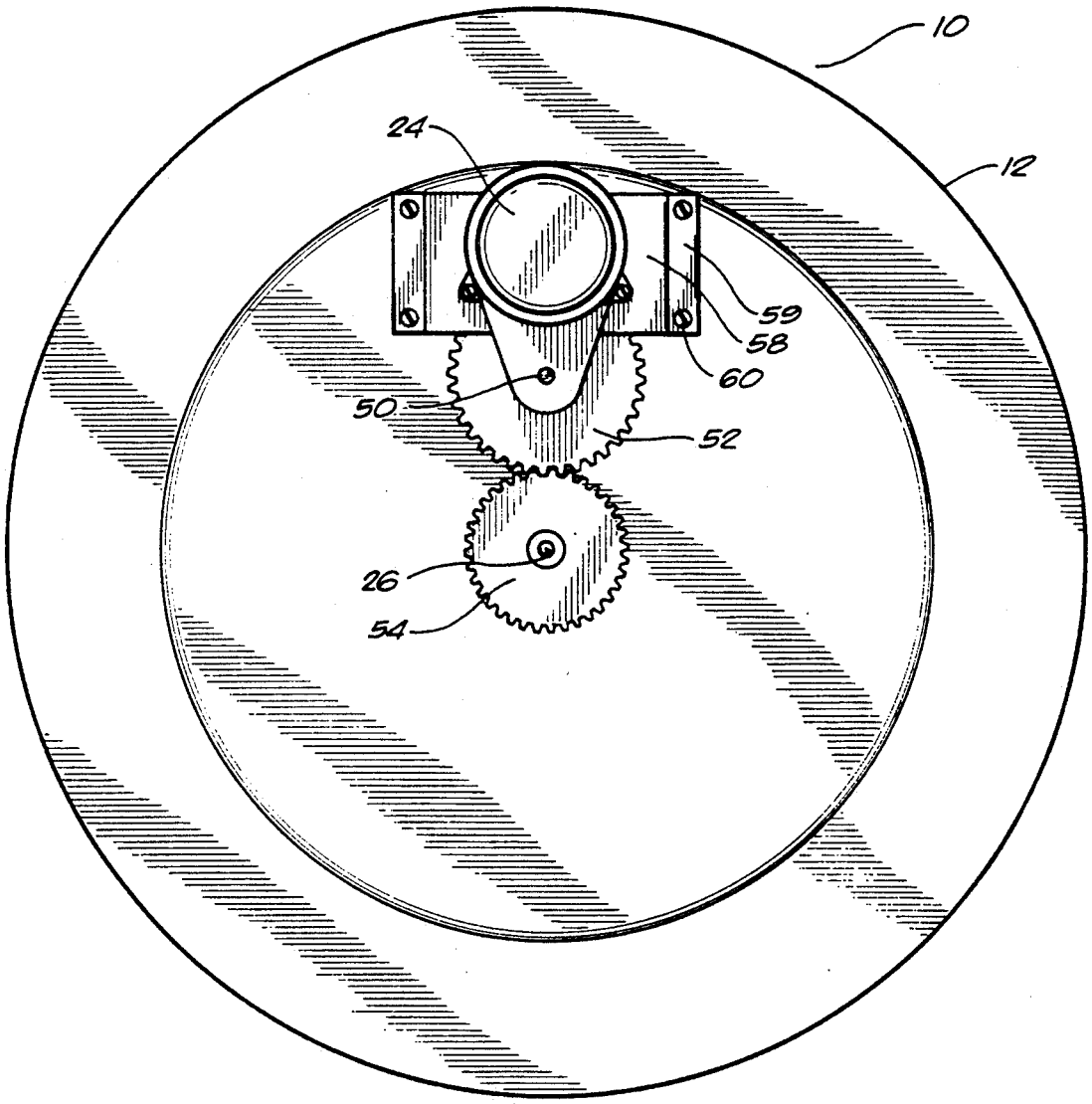
FIG. 2 is a schematic view of the back of the timepiece.
Figure 3:
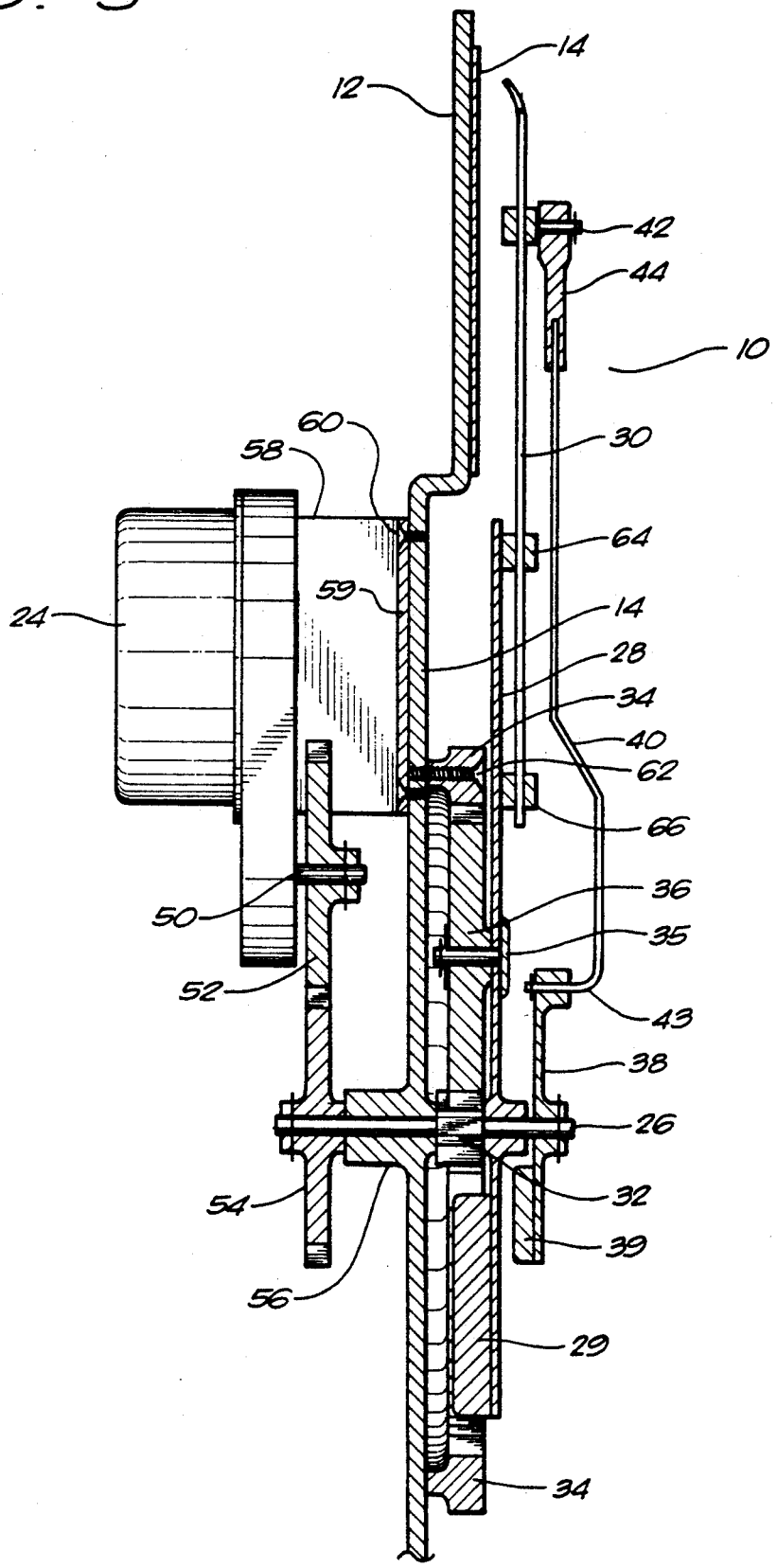
FIG. 3 is a sectional view of the timepiece taken on the line III—III of FIG. 1, but with the hand in a 12:00 position.

In the presently preferred embodiment of the invention, the timepiece has a case or body 12 with a face 14. As illustrated in FIGS. 2 and 3, the timepiece's clocking mechanism 24 is mounted to the back of the body 12 by means of a base 58. The base 58 is mounted to the body 12 with screws 60 through feet 59 formed in the base 58. Although the illustrated embodiment is a wall clock, the invention is of course similarly applicable in various other types of timepieces such as watches, desk clocks and the like.

The clocking mechanism 24 induces a rotation in an input shaft 50 at the rate of one revolution per hour. A first gear 52 is centrally mounted on the input shaft 50, and a second gear 54 is centrally mounted about an output shaft 26 in a position adjacent to hub 56 of the body 12. The teeth of the first gear 52 engage those of the second gear 54, thereby transmitting the torque developed in the clocking mechanism 24 to the output shaft 26 to induce rotation in the output shaft 26. The first gear 52 has 13/12 times the number of teeth of the second gear 54, effecting a 13 to 12 step-up in the speed of the output shaft 26 from that of the input shaft 50 for reasons which are explained below.

In an alternate embodiment of the invention, the stepped-up speed of the output shaft 26 could be accomplished by manipulating the gear train within the clocking mechanism 24 such that the clocking mechanism 24 directly drives the output shaft 26 at 13/12 times the speed of a standard clocking mechanism, thus obviating the need for input shaft 50, or gears 52 and 54.

Figure 1:
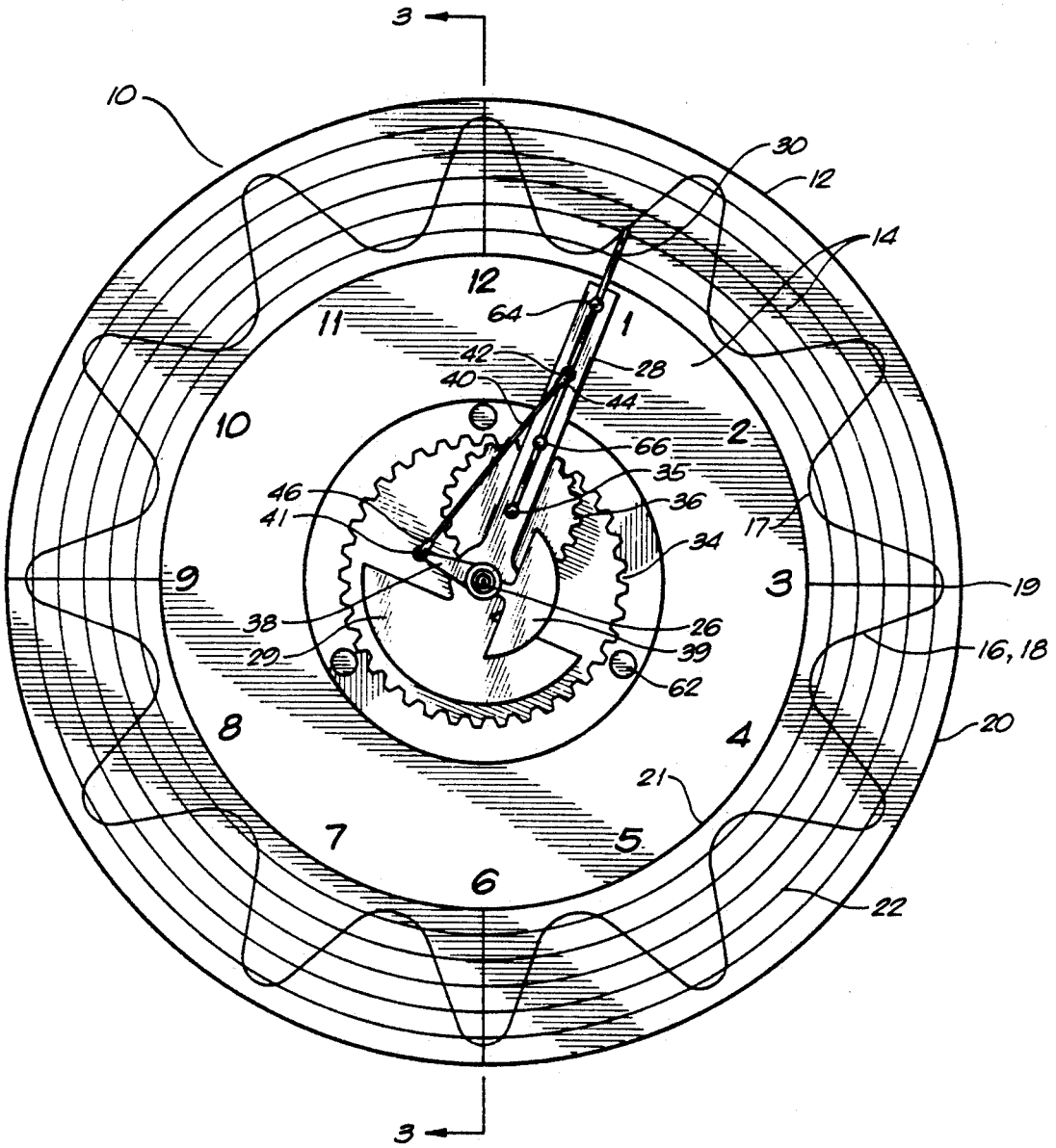
FIG. 1 is a schematic view of the face of a timepiece according to the present invention.

As shown in FIGS. 1 and 3, output shaft 26 extends through the body 12 and face 14 of the clock 10 at the center of the sinusoidal path 16 on the face 14. An arm 28 is mounted for rotation about the output shaft 26 and extends radially from the shaft 26. Arm 28 is equipped with a pendulum 29 for the purpose of counterbalancing its radially extending mass, as well as for aesthetic value.

Means are provided for connecting the output shaft 26 to the arm 28 for inducing stepped-down rotation of the arm 28 relative to the rotation of the output shaft 26. The stepped-down rotation is necessary because 13/12 revolutions of the output shaft 26 define one hour on the timepiece 10, i.e. the output shaft 26 rotates at 13/12 revolutions per hour, while one revolution of the arm 28 is designed to define twelve hours. Alternatively, the rotation rate of the arm could be designed for one revolution per every twenty-four hours in the case of a twenty-four hour timepiece.

In the preferred embodiment, the means connecting the output shaft 26 to the arm 28 comprise a sun gear 32 mounted centrally about the output shaft 26 and rotating with it, a ring gear 34 mounted with screws 62 on the face 14 of the body 12 centrally with respect to the output shaft 26, and a planetary gear 36 carried by the arm 28 radially outward from the output shaft 26 by means of a pin 35 extending through a bore in the arm 28 and the center of the planetary gear 36. The teeth of the planetary gear 36 engage those of the sun gear 32 and the ring gear 34, resulting in a clockwise rotation of the planetary gear 36 about the sun gear 32 upon clockwise rotation of the output shaft 26. The clockwise motion of the planetary gear 36 induces a clockwise rotation of the arm 28 about the output shaft 26.

The cooperative action of the three-gear system, commonly referred to as a planetary gear train, thereby results in a thirteen to one reduction from the angular velocity of the output shaft 26 (13/12 revolutions per hour) to that of the arm 28 (one revolution per every twelve hours). Those skilled in the art will recognize that the gear train selected is but one of several methods for effecting the step-down in the rotation rate of the arm 28 from the rotation rate of the output shaft 26.

A time-indicating pointer 30 is mounted for guided longitudinal movement with respect to the arm 28 by means of guide bosses 64 and 66. The bosses 64 and 66 are mounted to the arm 28 along its longitudinal axis, and are centrally bored such that the movement of the pointer 30 is constrained colinearly within the bores.

Means are provided for connecting the output shaft 26 to the pointer 30 for inducing reciprocating motion of the pointer 30 with respect to the arm 28. The reciprocating motion causes the pointer 30 to track the sinusoidal path 16 upon rotation of the output shaft 26 and the resulting rotational movement of the arm 28.

The sinusoidal path 16 comprises multiples of twelve wavelengths 18 within a circular periphery 20. In a presently preferred embodiment, the timepiece is a twelve hour clock 10 which employs exactly twelve wavelengths 18, each of which represents a single hour of time, as illustrated in FIG. 1. Hours begin with the crests 19 of each wavelength 18. The troughs 17 of each wavelength define the half-hour marks on the clock 10.

Concentric rings 22 displayed on the face 14 intersect the path 16. In the preferred embodiment, the number of intersecting rings 22 displayed is five. A sixth ring 21 defines the inner boundary of the peripheral area on which the sinusoidal path 16 lies. The use of five concentric rings 22 divides the path 16 into six segmented portions between the crests 19 and troughs 17 of each wavelength 18. This division enables a convenient allocation of five minute increments per segment defined by points along the path 16 intersected by the rings 22.

Therefore, beginning at the crest of a wavelength 18 and following the sinusoidal path 16 in a clockwise direction about the periphery of the face 14, the first ring 22 which the path 16 intersects represents an indication of five minutes past the hour. This pattern of incrementing time by five minutes per ring 22 is repeated until reaching the trough of the wavelength 18. At this point, continued clockwise travel along the path 16 results in the intersection with the same ring 22 indicative of twenty-five minutes past the hour, but which now represents thirty-five minutes past the hour. Each of the concentric rings 22 thus define a five minute increment in both the first thirty minutes of an hour and the last thirty minutes of the hour.

As it follows the path 16, the pointer 30 indicates hours by its circumferential position relative to the crests 19 of the wavelengths 18, and indicates minutes by its radial position relative to the concentric rings 22 which intersect the sinusoidal path 16 on the face of the timepiece 10. The present invention thus provides a timepiece that incorporates a single analog hand for the representation of hours and minutes based upon the radial as well as the circumferential position of the hand with respect to the face of the timepiece.

In a presently preferred embodiment, as illustrated in FIG. 3, the means connecting the output shaft 26 with the pointer 30 comprise a crank arm 38 connected to the output shaft 26 and a connecting rod 40 which is pivotally connected to the crank arm 38 by extending one end 43 of the rod 40, which is bent at a ninety degree angle, through a bore in the radially extending end of the crank 38, and is pivotally connected to the pointer 30 at the other end by a pin 42. The crank 38 is provided with pendulum 39 for the purpose of counterbalancing the radially extending mass of the crank 39 and the reactive force of connecting rod 40 at end 43, as well as for aesthetio value.

FIG. 1 displays an alternate embodiment of the pivotal connection between the crank 38 and the connecting rod 40. In this embodiment, the end of the connecting rod 40 is connected to the crank 38 by means of a pin 41.

A further alternative embodied in FIG. 1 is the location of the pivotal connection at the pin 42 between the connecting rod 40 and the pointer 30. In this alternative embodiment, pin 42 is extended through a bore in the pointer 30 which lies between bosses 64 and 66. In the preferred embodiment, this connection is made outside of the area between the bosses 64 and 66, such that boss 64 lies between the point at which pin 42 is inserted into the pointer 30 and boss 66 along the line of pointer 30, as displayed in FIG. 3.

The cooperative action of the crank 38, connecting rod 40, and pointer 30, collectively referred to as a sliding-block linkage, results in reciprocal motion of the pointer 30 which nearly parallels the rotation of the output shaft 26. The output shaft 26 and the pointer 30 do not cycle at the same rate, but at a ratio of 13 to 12. In other words, 13/12 revolutions of the output shaft 26 are required for one cycle of the pointer 30.

Figure 4A:
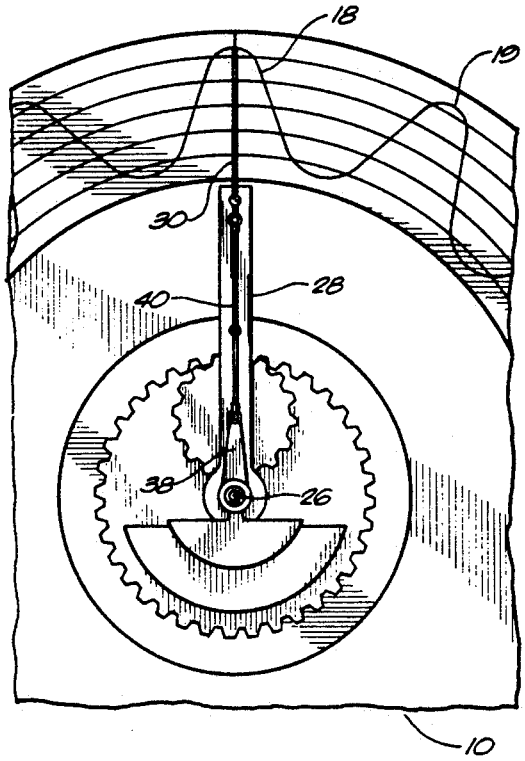
FIGS. 4A, 4B, and 4C are schematic views of the face of the timepiece, as shown in FIG. 1, but indicating times of 12:00, 12:55, and 1:00, respectively.
Figure 4B:
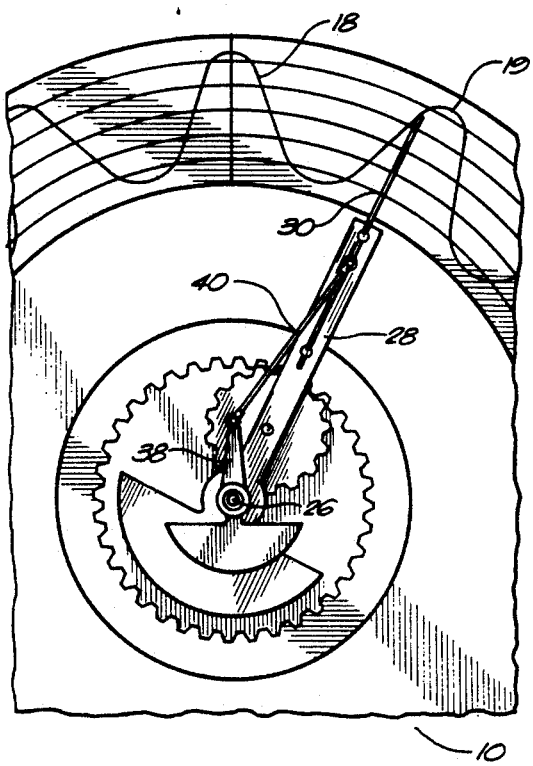
Figure 4C:
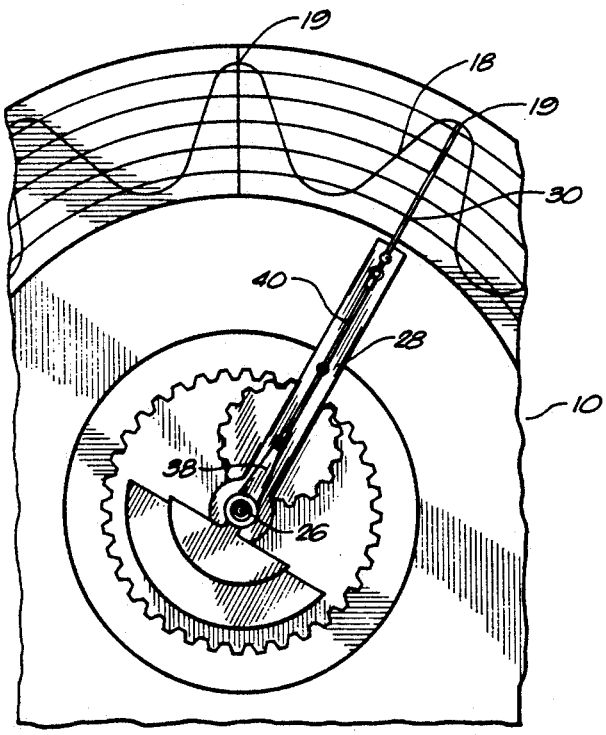

The nature of this relationship is clarified with reference to FIGS. 4A, 4B, and 4C. In FIG. 4A, the clock is displayed in the 12:00 position with the radially extending end of the crank 38 pointed upward and the connecting rod 40 aligned with the arm 28, pushing the pointer 30 to its maximum radial extension relative to the arm 28. FIG. 4B illustrates the clock 10 having undergone one clockwise revolution of the output shaft 26 and the attached crank 38 from the 12:00 position. As a result of the one revolution, the arm 28 is rotationally displaced by the action of the planetary gear train such that the connecting rod 40 is no longer aligned with the arm 28, and the pointer 30 is thus unable to achieve its maximum radial extension relative to the arm 28. An additional 1/12 revolution, or thirty degrees of rotation, is required for the pointer 30 to reach the 1:00 position shown in FIG. 4C. The output shaft 26 must therefore rotate 13/12 revolutions to position the end of the pointer 30 at the crests 19 of the wavelengths 18 upon each one hour increment of time.

From the foregoing it will be seen that this invention is well adapted to attain all the ends and objects herein set forth, together with other advantages which are obvious and inherent to the timepiece.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as being illustrative and not in a limiting sense.

What is claimed is:

1. A timepiece comprising:

a body having a face displaying a sinusoidal path of multiples of twelve wavelengths within a circular periphery, and concentric rings intersecting the path;

a clocking mechanism mounted on the body having an output shaft arranged centrally with respect to the sinusoidal path;

an arm mounted for rotation about the output shaft and extending radially from it;

means connecting the output shaft to the arm for inducing stepped-down rotation of the arm about the output shaft, whereby 13/12 revolutions of the output shaft define one hour and one revolution of the arm defines multiples of twelve hours;

a pointer mounted for guided longitudinal movement with respect to the arm;

means connecting the output shaft to the pointer for inducing reciprocating motion of the pointer with respect to the arm causing the pointer to track the sinusoidal path upon rotation of the output shaft, whereby the pointer indicates hours by its circumferential position relative to the crests of the wavelengths and indicates minutes by its radial position relative to the concentric rings.

2. The timepiece of claim 1 in which the means connecting the output shaft to the arm comprise:

a sun gear mounted on the output shaft and rotating with it;

a ring gear mounted on the face of the body centrally with respect to the output shaft; and a planetary gear carried by the arm radially outward from the output shaft with its teeth engaging those of the sun gear and the ring gear.

3. The timepiece of claim 1 in which the means connecting the output shaft to the pointer comprise:

a rotating crank connected to the output shaft and rotating with it; and a connecting rod pivotally connected to the rotating crank and the pointer.

4. The timepiece of claim 2 in which the means connecting the output shaft to the pointer comprise:

a rotating crank connected to the output shaft and rotating with it; and a connecting rod pivotally connected to the rotating crank and the pointer.

5. The timepiece of claim 1 in which the number of wavelengths in the sinusoidal path is twelve.

6. The timepiece of claim 1 in which the number of concentric rings intersecting the sinusoidal path is five.

* * * * *